US005759458A

United States Patent [19]

Haaland et al.

[11] Patent Number: 5,759,458

[45] Date of Patent: Jun. 2, 1998

[54] PROCESS FOR THE MANUFACTURE OF HIGH PERFORMANCE GUN PROPELLANTS

[75] Inventors: Andrew C. Haaland, Park City; Paul C. Braithwaite, Brigham City, both of Utah; James A. Hartwell, Elkton, Md.; Val D. Lott, Ogden; Michael T. Rose, Tremonton, both of Utah

[73] Assignee: Thiokol Corporation, Ogden, Utah

[21] Appl. No.: 687,887

[22] Filed: Jul. 26, 1996

[51] Int. Cl.[6] ..... C06B 21/00

[52] U.S. Cl. ..... 264/3.3

[58] Field of Search ..... 264/3.3

[56] References Cited

U.S. PATENT DOCUMENTS

| | | | |
|---|---|---|---|
| 4,361,526 | 11/1982 | Allen | 264/3 C |
| 4,650,617 | 3/1987 | Kristofferson et al. | 264/3.3 |
| 4,707,540 | 11/1987 | Mansar et al. | 528/417 |
| 4,764,316 | 8/1988 | Brown et al. | 264/3.1 |
| 4,764,586 | 8/1988 | Manser et al. | 528/362 |
| 4,806,613 | 2/1989 | Wardle | 528/59 |
| 4,919,737 | 4/1990 | Biddle et al. | 149/19.5 |
| 4,976,794 | 12/1990 | Biddle et al. | 149/19.5 |
| 5,210,153 | 5/1993 | Mansar et al. | 525/410 |
| 5,467,714 | 11/1995 | Lund et al. | 102/284 |
| 5,529,649 | 6/1996 | Lund et al. | 149/19.3 |
| 5,587,553 | 12/1996 | Braithwaite et al. | 149/19.6 |
| 5,591,936 | 1/1997 | Willer et al. | 149/19.4 |

OTHER PUBLICATIONS

L.E. Harris, S. Moy, T. Manning, R. B. Wardle, A. Haaland, J. A. Hartwell, T. Cordeschi, and J. G. Buzzett, "Plasma Ignition of Advanced Solid Propellants", JANNAF Propulsion Meeting (Dec. 8, 1995).

*Primary Examiner*—Peter A. Nelson
*Attorney, Agent, or Firm*—Cushman Darby & Cushman IP Group of Pillsbury Madison & Sutro LLP

[57] ABSTRACT

A process for manufacturing a high performance gun propellant containing an energetic thermoplastic elastomeric binder and a high-energy oxidizer is disclosed. The process includes preparing or obtaining a molding powder of the high-energy oxidizer particles coated with the energetic thermo-plastic elastomeric binder and extruding the molding powder into the desired gun propellant configuration. The high-energy oxidizer has a concentration in the range from 70% to 85%, by weight, and the energetic thermoplastic elastomeric binder has a concentration in the range from 15% to 30%, by weight. The molding powder has a particle size in the range from 200 μ to 2000 μ. Typical thermoplastic elastomeric binders include oxetane, oxirane, and nitramine backbone polymers, copolymers, and mixtures thereof. Typical high-energy oxidizers include nitramine oxidizers.

22 Claims, No Drawings

PROCESS FOR THE MANUFACTURE OF HIGH PERFORMANCE GUN PROPELLANTS

BACKGROUND OF THE INVENTION

1. Field of the Invention

This invention relates to the processing of high performance gun propellants which use an energetic thermoplastic elastomer (TPE) binder in combination with a high energy oxidizer.

2. Technology Background

There is a continuing need for high performance gun propellants which exceed the performance of currently fielded gun propellants and which are easily processed. As an example, the current Army 120 mm tank round gun propellant is a double base propellant (JA2) containing nitrocellulose, nitroglycerine, and an energetic plasticizer. This composition is gelled. If the gun propellant is processed or gelled improperly, the material cannot be easily reprocessed. The gun propellant JA2 has an impetus of about 1190 J/g and a flame temperature of about 3400° K.

Persons skilled in the art have previously proposed using an energetic thermoplastic elastomeric binder instead of nitrocellulose. For instance, U.S. Pat. No. 4,919,737 to Biddle et al. discloses a gun propellant composition containing an energetic thermoplastic elastomeric ("TPE") binder and a high-energy oxidizer. Oxetane polymers, such as copoly-BAMO/AMMO (bisazidomethyloxetane/azidomethyl-methyloxetane) and copoly-BAMO/NMMO (bisazidomethyloxetane/nitraminomethyl-methyloxetane) are disclosed TPE binders. According to Biddle et al. (column 4, lines 26–32), these gun propellants are prepared mixing at a temperature between 100° C. and 125° C., followed by extrusion at a temperature between 70° C. and 130° C. The high temperatures melt the thermoplastic elastomeric binder and allow the propellant to be processed.

A major disadvantage of Biddle et al.'s processing technique is the need to heat the energetic binder and high energy oxidizer to very high processing temperatures. This creates a substantial hazard to equipment and personnel. It also limits the quantity of gun propellant that can be safely processed at any one time. This batch technique can safely process only about 200 grams due to safety and rheological constraints.

It would be a significant advancement in the art to provide a process for manufacturing a high performance gun propellant containing an energetic thermoplastic elastomeric binder and a high-energy oxidizer which enables the safe processing of large quantities of high performance gun propellant.

Such processes of manufacturing a high performance gun propellant are disclosed and claimed herein.

SUMMARY OF THE INVENTION

The present invention is directed to a process of making high performance gun propellants containing an energetic thermoplastic elastomer binder in combination with a high energy oxidizer. The process includes extrusion of a suitable molding powder consisting of high energy oxidizer particles coated with the energetic binder. The molding powder preferably has a concentration of high-energy oxidizer in the range from 70% to 85%, by weight, and a concentration of the energetic thermoplastic elastomeric binder in the range from 15% to 30%, by weight. More preferably, the molding powder has a concentration of high-energy oxidizer in the range from 76% to 82%, by weight, and a concentration of the energetic thermoplastic elastomeric binder in the range from 18% to 24%, by weight.

Polymer precipitation is used prepare the molding powder. At its simplest, polymer precipitation involves dissolving the energetic polymer in a solvent, adding the solid oxidizer and stirring vigorously, then adding a nonsolvent (relative to the polymer and dry ingredients) to the system to cause precipitation of the polymer. Thus, polymer precipitation is used to uniformly coat the solid oxidizer particles with the precipitated polymer. The coated particles are then extruded into the shape desired for gun propellant.

In a currently preferred embodiment, the thermoplastic elastomeric polymer is dissolved in a solvent to form a lacquer. The high energy oxidizer particles are slurried with water and stirred. The lacquer and slurry are gradually combined, and the polymer precipitates onto the particles. The coated particles are collected and dried. The particle size is preferably in the range from about 200 μ to 2000 μ, and more preferably in the range from 200 μ to 1000 μ, and most preferably in the range from 500 μ to 1000 μ. This process can safely prepare large scale batches of gun propellant at lower cost than previous methods.

The molding powder properties are affected by the solvent concentration, the mixing rate of the polymer and the oxidizer slurry, the agitation rate of the oxidizer slurry, the oxidizer concentration in the slurry, the temperature of the reaction vessel, and the original particle size of the high energy oxidizer. Too much solvent causes the polymer to be sticky and not free flowing. A typical ratio of polymer to solvent is about 1:1.5, by weight. Increased agitation of the oxidizer slurry tends to decrease the particle size of the molding powder. A more dilute oxidizer slurry tends to produce smaller molding powder granules. A typical ratio of oxidizer particles to water is about 5:1, by weight. Colder temperatures also tend to decrease the particle size. Although somewhat solvent dependent, a typical temperature range is from 5° C. to 50° C. Finally, if the original oxidizer particle size is too small and the quantity of polymer is limited, the particles may be poorly coated. For CL-20 oxidizer particles, a typical particle size range is from 3 μ to 135 μ.

The molding powder is extruded according to conventional ram or screw extrusion technology. The extruder preferably has a barrel and a die which are jacketed to allow temperature control during the extrusion process. Various die configurations can be used. For instance, solid and perforated dies can be used at various diameters to form a strand of extruded gun propellant. The strand can be cut to a desired length or rolled into sheets. Importantly, because a TPE is used, the inventors have found that extruded material which contains irregularities or imperfections can be chopped up and re-extruded without the use of solvents or processing aids.

The extrusion process is accomplished by adding the molding powder to the extruder. Ram extruders and twin screw extruders can be used. A "thermal soak" step is often performed prior to extrusion to bring the molding powder temperature close to the desired extrusion temperature. The thermal soak can be simple preheating at the desired extrusion temperature. The thermal soak has also been performed by mixing the molding powder in a batch mixer at a temperature above the melt temperature of the TPE while applying a vacuum. The molding powder can be preconsolidated before extrusion through the die. The extruded gun propellant is cut to the desired length or rolled to form sheets.

Ideally, the extruded gun propellant should have a substantially flat velocity gradient as it exits the die and a smooth surface finish. The extrusion process can be affected by factors such as barrel temperature, die temperature and length, extrusion pressure, conveyor speed, thermal soak time prior to extrusion, and die surface finish.

It will be appreciated that suitable molding powders can be prepared according to the present invention at temperatures significantly lower than those taught by Biddle et al. The present invention also enables safe processing of large scale batches of gun propellant.

DETAILED DESCRIPTION OF THE INVENTION

The invention is directed to a process for manufacturing a high performance gun propellant containing an energetic thermoplastic elastomeric binder and a high-energy oxidizer. The process includes preparing or obtaining a molding powder of the high-energy oxidizer particles coated with the energetic thermoplastic elastomeric binder and extruding the molding powder into the desired gun propellant configuration.

Suitable molding powders have a concentration of high-energy oxidizer in the range from 70% to 85%, by weight, and a concentration of energetic thermoplastic elastomeric binder in the range from 15% to 30%, by weight. The molding powder has a particle size in the range from 200 μ to 2000 μ, and more preferably in the range from 200 μ to 1000 μ, and most preferably in the range from 500 μ to 1000 μ.

Typical energetic thermoplastic elastomeric binders include, but are not limited to, oxetane, oxirane, and nitramine backbone polymers, copolymers, and mixtures thereof. Examples of such TPE binders include, but are not limited to, PGN (polyglycidyl nitrate), poly-NMMO (nitratomethyl-methyl-oxetane), GAP (polyglycidyl azide), 9DT-NIDA (diethylene-glycol-triethyleneglycol-nitraminodiacetic acid terpolymer), poly-BAMO (poly(bis(azidomethyl)oxetane)), poly-AMMO (poly(azidomethyl-methyloxetane)), poly-NAMMO (poly(nitra-minomethyl-methyloxetne)), poly-BFMO (poly(bis(difluoro-aminomethyl) oxetane)), poly-DFMO (poly(difluoroaminomethyl-methyloxetane)), and copolymers and mixtures thereof. Known and novel non-energetic thermoplastic elastomeric binders, such as Du Pont Hytrel thermoplastic elastomers, can also be used in the process of the present invention.

Typical high-energy oxidizers include known and novel nitramine oxidizers. Examples of such high-energy oxidizers include, but are not limited to, CL-20 (2,4,6,8,10,12-hexa-nitro-2,4,6,8,10,12-hexaazatetracyclo $[5.5.0.0^{5,9}.0^{3,11}]$-dodecane, RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4,10-diazatetracyclo $[5.5.0.0^{5,9}.0^{3,11}]$dodecane), NTO (3-nitro-1,2,4-triazol-5-one), NQ (nitroguanidine), TATB (1,3,5-triamino-2,4,6-trinitrobenzene), TNAZ (1,3,3-trinitro-azetidine), ADN (ammonium dinitramide), DADNE (1,1-diamino-2,2-dinitro ethane), and mixtures thereof.

The molding powder is preferably prepared using a polymer precipitation technique in which the TPE precipitates and coats the oxidizer particles. A currently preferred method of coating the oxidizer particles is combining a slurry of high-energy oxidizer particles with a solvent solution of the TPE binder. The oxidizer particle slurry is preferably aqueous for safety reasons, because water lowers the sensitivity to electrostatic discharge ("ESD"), impact, and friction. Water is also preferred solvent for cost and environmental reasons.

The TPE solvent is preferably selected based on its ability to dissolve the polymer, its toxicity, and its ability to precipitate the TPE when combined with the oxidizer slurry. Ethyl acetate is a currently preferred solvent because of cost and environmental considerations. $MeCl_2$, toluene, chloroform, acetone, trichloroethane, methyl chloroform, THF, and other equivalent solvents can also be used according to the present invention.

The molding powder is extruded according to conventional extrusion techniques. Use of ram extruders and twin screw extruders are two currently preferred extrusion methods. Ram extrusion pressures typically range from 600 to 2500 psi. The extruder preferably provides temperature control in both the barrel and die. The ability to control the temperature during extrusion provides the ability to vary the characteristics of the extruded product. The die temperature is usually cooler than the barrel temperature. For instance, when copoly-BAMO/AMMO is used, the die temperature is maintained in a range from about 60° C. to 75° C., while the extruder barrel temperature is maintained in a range from 60° C. to 85° C. The barrel temperature can broadly range from 40° C. to 120° C. The extruded gun propellant is preferably cut to a desired length or further processed into the desired gun propellant configuration. In some cases the extruded gun propellant strand is rolled into a sheet.

Various die configurations can be used. For instance, solid and perforated dies can be used at various diameters and cross-section configurations. Solid and perforated strands ranging from 0.125 inch to 0.5 inch diameter have been successfully extruded.

The present invention is further described in the following nonlimiting examples.

EXAMPLE 1

Several molding powders were prepared by combining an energetic polymer lacquer solution with a stirred RDX slurry. The lacquer solution was prepared by dissolving copoly-BAMO/AMMO (copoly(bis(azidomethyl)oxetane)/(azidomethyl-methyl-oxetane)) in a solvent selected from methylene chloride ($MeCl_2$), toluene, and ethyl acetate. 1.5 g of solvent for each 1 g of TPE were used. The BAMO/AMMO polymer contained 25% BAMO and 75% AMMO, by weight. The polymer had a number average molecular weight ($M_n$) from 8000 to 50,000, with a median number average molecular weight of about 20,000. The molecular weight was determined by GPC (gel permeation chromatography) using polystyrene as the calibration standard according to conventional techniques. The polymer melting point was 90° C.±20° C., and the glass transition temperature was −40° C.±20° C.

The RDX slurry was prepared by dispersing RDX having a particle size of about 7 μ in a working fluid selected from water and isopropyl alcohol ("IPA"). The ratio of TPE to RDX ranged from 24:76 to 18:82. The BAMO/AMMO solution was added to the RDX slurry. The BAMO/AMMO uniformly coated the RDX particles to produce molding powders which ranged from free-flowing granules (preferred form) to non-free flowing disks. Table 1 summarizes the molding powder batches. As shown in Table 1, the choice of solvent and working fluid affects rheological characteristics, further processing capability, and overall quality of the molding powder.

TABLE 1

| RDX:BAMO/AMMO Ratio | Batch Size (g) | PSD (μ) | Solvent/ Working Fluid | Appearance |
|---|---|---|---|---|
| 76:24 | 100 | 7.2 | $MeCl_2$/water | Non-flowing large disks |
| 82:18 | 50 | 1.9 | Toluene/IPA | Non-flowing large disks |
| 82:18 | 100 | 1.9 | Ethyl acetate/ water | Free flowing agglomerates |
| 82:18 | 100 | 7.2 | Ethyl acetate/ water | Free flowing agglomerates |
| 82:18 | 100 | 1.9 | $MeCl_2$/water | Semi-free flowing agglomerates |
| 82:18 | 50 | 1.9 | Toluene/water | Non-flowing large disks |

EXAMPLE 2

Molding powders prepared using the technique described in Example 1 were added to a two-inch diameter ram extruder having a 0.125-inch, seven-perforation die. The die temperature was maintained at 60° C., while the barrel temperature was maintained at 75° C. The pressing foot of the ram was lowered into the extrusion barrel and approximately 500 psi of pressure was applied to the pressing foot to begin consolidation of the molding powder and to improve heat transfer between the extruder and the molding powder. The molding powder was allowed to equilibrate for one hour to the temperature controlled barrel and die. The molding powder was extruded from the barrel through a 0.125-inch, seven perforation die, and onto a four-inch wide conveyor. The pressure required to extrude the material was 2500 psi. If the surface finish or density of the extruded material was not acceptable, the material was chopped and recycled as feed stock for subsequent extrusions. Suitable extruded strands were cut into 1.5 length-to-diameter grains.

EXAMPLE 3

A high performance gun propellant was prepared according to the procedure of Examples 1 and 2, except that CL-20 was used instead of RDX and the CL-20 had a concentration of 76% while the BAMO/AMMO had a concentration of 24%. The extruder die temperature was 67° C., and the extruder barrel temperature was 78° C.

EXAMPLE 4

A high performance gun propellant was prepared according to the procedure of Examples 1 and 2, except that 56% CL-20 and 20% NQ were used instead of RDX. The BAMO/AMMO concentration in the formulation was 24% and the ratio of BAMO to AMMO in the polymer was 25/75.

EXAMPLE 5

Computer modeling calculations comparing the theoretical impetus and flame temperatures for several high performance gun propellant formulations processed according to the present invention are summarized in Table 2 below:

TABLE 2

| Gun Propellant Formulation | Impetus | Flame Temperature |
|---|---|---|
| 76% RDX<br>24% BAMO/AMMO | 1182 J/g | 2827° K. |
| 76% CL-20<br>24% BAMO/AMMO | 1291 J/g | 3378° K. |
| 56% CL-20<br>20% ANF<br>24% BAMO/AMMO | 1247 J/g | 3217° K. |
| 56% CL-20<br>20% NQ<br>24% BAMO/AMMO | 1144 J/g | 2846° K. |

The results reported in Table 2 suggest that a high energy TPE binder in combination with a nitramine oxidizer provides significantly higher performance characteristics compared to a conventional gun propellant formulation.

EXAMPLE 6

A layered sheet of different high performance gun propellant compositions was prepared from two different gun propellant compositions prepared according to the procedure of Example 1. The first composition contained 24% BAMO/AMMO and 76% RDX, by weight. The BAMO/AMMO contained 25% BAMO and 75% AMMO, by weight. The second composition contained 24% BAMO/AMMO and 76% CL-20, by weight. The BAMO/AMMO contained 25% BAMO and 75% AMMO, by weight.

The first and second compositions were originally extruded as 0.5 inch solid strands. The strands were preheated and passed through a roll mill to flatten each composition into a sheet. The CL-20 composition was sandwiched between two RDX sheets, and layers were passed through the roll mill. The final thickness was about 0.1 inch, with the two outer, RDX layers having a thickness of about 0.013 inch and the inner, CL-20 layer having a thickness of about 0.974 inch. The layered sheet was annealed in an oven at about 75° C. for 1 hour.

SUMMARY

The process of the present invention solves several problems currently associated with gun propellant manufacture. The molding powder can be prepared using minimal amounts of solvents which are not detrimental to the environment. Currently fielded gun propellant systems utilize double or triple base formulations which require relatively large quantities of solvents that are environmental hazards. This process minimizes the time that the energetic materials are processed at high (nominally 100° C.) temperatures. Lower temperatures reduce safety hazards and mitigate concerns associated with changes in the chemical structure of some raw materials. Extrusion of molding powder also eliminates the need for use of additional solvents in the manufacturing process.

Current extrusion processes utilized for gun propellant manufacture utilize a variety of volatile solvents to enable grain fabrication. The use of these solvents causes both additional cost and environmental concerns. The process within the scope of the present invention allows the use of TPE binder systems and other energetic materials in gun propellants beyond the laboratory scale. Traditional laboratory processes have relied on melting the TPE in a vertical batch mixer prior to incorporation of other energetic ingredients in the formulation. This prior process is difficult, poses several safety issues, and is often not feasible to accomplish above 200 gram scale due to safety, heat transfer, and rheological constraints. The process within the scope of the present invention allows TPE binder systems and energetic solid materials to be prepared in larger scale batches at lower cost with reduced safety concerns.

The invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A process for manufacturing a high performance gun propellant containing an energetic thermoplastic elastomeric binder and a high-energy oxidizer comprising the steps of:

obtaining a molding powder comprising the high-energy oxidizer particles coated with the energetic thermoplastic elastomeric binder, wherein the high-energy oxidizer has a concentration in the range from 70% to 85%, by weight, and the energetic thermoplastic elastomeric binder has a concentration in the range from 15% to 30%, by weight, wherein the molding powder has a particle size in the range from 200 μ to 2000 μ;

(b) extruding the molding powder with an extruder having a barrel and a die to form an extruded gun propellant; and (c) rolling the extruded gun propellant into at least one gun propellant sheet.

2. A process for manufacturing a high performance gun propellant as defined in claim 1, wherein the molding powder has a particle size in the range from 200 μ to 1000 μ.

3. A process for manufacturing a high performance gun propellant as defined in claim 1, wherein the molding powder has a particle size in the range from 500 μ to 1000 μ.

4. A process for manufacturing a high performance gun propellant as defined in claim 1, further comprising the step of cutting the extruded gun propellant to a desired configuration.

5. A process for manufacturing a high performance gun propellant as defined in claim 1, wherein said process the temperature of the extruder barrel is in the range of 40° C. to 120° C.; and during the extruding step the gun propellant is extruded through the die at a pressure in the range of from 600 to 2500 psi.

6. A process for manufacturing a high performance gun propellant as defined in claim 1, further comprising the steps of obtaining a plurality of sheets of gun propellant and rolling the plurality of sheets to form a layered sheet of gun propellant.

7. A process for manufacturing a high performance gun propellant containing an energetic thermoplastic elastomeric binder and a high-energy oxidizer comprising the steps of:

(a) obtaining a molding powder comprising high-energy oxidizer particles coated with the energetic thermoplastic elastomeric binder, wherein the high-energy oxidizer has a concentration in the range from 70% to 85%, by weight, and the energetic thermoplastic elastomeric binder has a concentration in the range from 15% to 30%, by weight, wherein the molding powder has a particle size in the range from 200 μ to 2000 μ, wherein the energetic thermoplastic elastomeric binder is selected from the group consisting of poly-NMMO (nitratomethyl-methyloxetane), GAP (polyglycidyl azide), poly-BAMO (poly(bis(azido-methyl)oxetane)), poly-AMMO (poly(azidomethyl-methyl-oxetane)), poly-NAMMO (poly(nitraminomethyl-methyloxetane)), poly-BFMO (poly(bis(difluoroaminomethyl) oxetane)), poly-DFMO (poly (difluoroaminomethylmethyl-oxetane)), and copolymers and mixtures thereof, wherein the high energy oxidizer is at least one selected from CL-20 (2,4,6,8,10,12-hexanitro-2,4,6,8,10,12-hexaazatetracyclo-[5.5.0.0$^{5,9}$.0$^{3,11}$]-dodecane), RDX (1,3,5-trinitro-1,3,5-triazacyclohexane), HMX (1,3,5,7-tetranitro-1,3,5,7-tetraazacyclooctane), TEX (4,10-dinitro-2,6,8,12-tetraoxa-4, 10-diazatetracyclo[5.5.0.0$^{5,9}$.0$^{3,11}$] dodecane), NTO (3-nitro-1,2,4-triazol-5-one), NQ (nitroguanidine), TATB (1,3,5-triamino-2,4,6-trinitrobenzene), TNAZ (1,3,3-trinitroazetidine), ADN (ammonium dinitramide), and DADNE (1,1-diamino-2,2-dinitro ethane); and (b) extruding the molding powder with an extruder having a barrel and a die to form an extruded gun propellant; and (c) rolling the extruded gun propellant into at least one gun propellant sheet.

8. A process for manufacturing a high performance gun propellant as defined in claim 7, further comprising the step of cutting the extruded gun propellant to a desired configuration.

9. A process for manufacturing a high performance gun propellant as defined in claim 7, wherein said process the temperature of the extruder barrel is in the range of 40° C. to 120° C.; and during the extruding step the gun Propellant is extruded through the die at a pressure in the range of from 600 to 2500 psi.

10. A process for manufacturing a high performance gun propellant as defined in claim 1, wherein the concentration of the high-energy oxidizer is in the range of 76% to 82%.

11. A process for manufacturing a high performance gun propellant as defined in claim 1, further comprising the step of maintaining the temperature of the extruder die at a temperature in the range from 60° C. to 75° C.

12. A process for manufacturing a high performance gun propellant as defined in claim 1, further comprising the step of maintaining the temperature of the extruder barrel at a temperature in the range from 40° C. to 120° C.

13. A process for manufacturing a high performance gun propellant as defined in claim 1, further comprising the step of maintaining the temperature of the extruder barrel at a temperature in the range from 60° C. to 85° C.

14. A process for manufacturing a high performance gun propellant as defined in claim 1, wherein the extruder die is perforated.

15. A process for manufacturing a high performance gun propellant as defined in claim 14, wherein the extruder die has a diameter in the range from 0.125 inch to 0.5 inch.

16. A process for manufacturing a high performance gun propellant as defined in claim 1, wherein the extruder die produces a solid strand.

17. A process for manufacturing a high performance gun propellant as defined in claim 16, wherein the extruder die has a diameter in the range from 0.125 inch to 0.5 inch.

18. A process for manufacturing a high performance gun propellant as defined in claim 1, wherein the gun propellant is extruded through the die at a pressure in the range from 600 to 2500 psi.

19. A process for manufacturing a high performance gun propellant as defined in claim 1, wherein the high energy oxidizer is CL-20 (2,4,6,8,10,12-hexanitro-2,4,6,8,10,12-hexaazatetracyclo [5.5.0.0$^{5,9}$.0$^{3,11}$]-dodecane) and wherein the energetic thermoplastic elastomeric binder is copoly BAMO/AMMO (copoly(bis(azidomethyl)oxetane)/(azidomethyl-methyloxetane)).

20. A process for manufacturing a high performance gun propellant as defined in claim 1, wherein the molding powder is prepared by combining an aqueous slurry of high-energy oxidizer particles with an ethyl acetate solution of the energetic thermoplastic elastomeric binder.

21. A process for manufacturing a high performance gun propellant as defined in claim 1 or 7 wherein said at least one gun propellant sheet is multi-layered.

22. A process for manufacturing a high performance gun propellant as defined in claim 21, wherein said method further comprises thermal soaking the molding powder before conducting step (b).

* * * * *